US008122749B2

(12) United States Patent
Yamane

(10) Patent No.: US 8,122,749 B2
(45) Date of Patent: Feb. 28, 2012

(54) MANDREL MILL AND PROCESS FOR MANUFACTURING A SEAMLESS PIPE

(75) Inventor: Akihito Yamane, Kyoto (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/385,618

(22) Filed: Apr. 14, 2009

(65) Prior Publication Data

US 2009/0308125 A1 Dec. 17, 2009

Related U.S. Application Data

(63) Continuation of application No. PCT/JP2007/070083, filed on Oct. 15, 2007.

(30) Foreign Application Priority Data

Oct. 16, 2006 (JP) ..... 2006-281515

(51) Int. Cl.
*B21B 23/00* (2006.01)

(52) U.S. Cl. ..... 72/366.2; 72/208; 72/224

(58) Field of Classification Search ..... 72/96, 97, 72/208, 209, 224, 235, 368, 370.01, 8.9, 72/9.2, 11.6, 11.8, 234, 100, 252.5, 365.2, 72/366.2

See application file for complete search history.

(56) References Cited

U.S. PATENT DOCUMENTS

| | | | | | |
|---|---|---|---|---|---|
| 2,458,110 | A | * | 1/1949 | Sleeman | 72/100 |
| 3,874,211 | A | * | 4/1975 | Hayashi | 72/208 |
| 5,109,689 | A | * | 5/1992 | D'Avanzo | 72/97 |
| 5,501,091 | A | * | 3/1996 | Hayashi | 72/13.4 |
| 5,513,511 | A | * | 5/1996 | Imae et al. | 72/208 |
| 5,657,659 | A | * | 8/1997 | Yamada | 72/208 |

FOREIGN PATENT DOCUMENTS

| | | | |
|---|---|---|---|
| JP | 58-116907 | * | 7/1983 |
| JP | 62-28011 | * | 2/1987 |
| JP | 62-270204 | | 11/1987 |
| JP | 8-19806 | | 1/1996 |
| JP | 8-71614 | | 3/1996 |
| JP | 8-71615 | | 3/1996 |
| JP | 9-38711 | | 2/1997 |
| JP | 11-123409 | | 5/1999 |
| JP | 2005-111518 | | 4/2005 |
| JP | 2005-131706 | | 5/2005 |

* cited by examiner

*Primary Examiner* — Edward Tolan
(74) *Attorney, Agent, or Firm* — Clark & Brody

(57) ABSTRACT

A mandrel mill is provided which can perform elongation rolling with a markedly increased working ratio and dimensional accuracy on a material which is inherently difficult to roll such as a hollow shell made of stainless steel or a thin-walled material. A mandrel mill for manufacturing a mother tube by performing elongation rolling of a hollow shell comprises a plurality of roll stands, having at least one 4-roll stand for wall thickness reduction of a hollow shell and at least one 2-roll stand including the final stand downstream of the 4-roll stand.

11 Claims, 3 Drawing Sheets

MANDREL MILL AND PROCESS FOR MANUFACTURING A SEAMLESS PIPE

This application is a continuation of International Patent Application No. PCT/JP2007/070083, filed Oct. 15, 2007. This PCT application was not in English as published under PCT Article 21(2).

TECHNICAL FIELD

This invention relates to a mandrel mill and a process for manufacturing a seamless pipe. Specifically, it relates to a mandrel mill and a process for manufacturing a seamless pipe which can perform elongation rolling with a much higher working ratio and dimensional accuracy than at present on a difficult-to-roll material such as stainless steel pipe or a thin-walled steel pipe.

BACKGROUND ART

When manufacturing a seamless steel pipe by the Mannesmann mandrel mill process, first, a round or square billet is charged into a heating furnace and heated. Next, the round or square billet undergoes piercing rolling using a piercer to form a thick-walled hollow shell. Then, a mandrel bar is inserted into the hollow shell, and the shell undergoes elongation rolling using a mandrel mill, which typically comprises 5 to 8 roll stands, to decrease the wall thickness to a predetermined value and form a mother tube. The mandrel bar is then withdrawn from the mother tube, and the mother tube undergoes sizing rolling using a reducing mill to give a predetermined outer diameter and thereby manufacture a seamless steel pipe which is a final product.

A mandrel mill for carrying out elongation rolling is typically a 2-roll mandrel mill having two sets of elongation rolls disposed in each roll stand. However, with a 2-roll mandrel mill, the extent of deformation of a hollow shell which is being rolled greatly differs between portions of the hollow shell corresponding to the groove bottoms of the rolls (referred to below simply as the groove bottom portions of the shell) and the portions thereof corresponding to the flange portions of the rolls (referred to below simply as the flange portions of the shell). Therefore, the stress balance in a hollow shell which undergoes elongation rolling in a 2-roll mandrel mill is easily upset, and it is difficult to achieve a high working ratio with a 2-roll mandrel mill.

In recent years, use of a 3-roll mandrel mill in place of a 2-roll mandrel mill, which is difficult to achieve a high working ratio, has been disclosed (see Patent Document 1, for example).

In order to suppress the occurrence of thickness deviations which is a phenomenon in which four locations in the circumferential direction of a hollow shell locally become thickened due to rolling with a 2-roll mandrel mill, it has been proposed to employ a 4-roll stand which performs local reduction of the four locations where the wall thickness is increased as the final stand of a mandrel mill. Patent Documents 2 and 3 disclose rolling techniques and equipment for carrying out such proposal.

However, if roll stands having a different number of rolls are installed in the same mandrel mill, the equipment becomes complicated, and design and improvement of the equipment become difficult.

In a 2-roll mandrel mill, a pair of opposing grooved rolls can contact each other at their roll flanges. Therefore, zero point adjustment of the reduction positions of the rolls can be easily carried out. In contrast, with a 3-roll mandrel mill or a 4-roll mandrel mill, such contact between rolls cannot be achieved. Therefore, zero point adjustment of the reduction position of the rolls is difficult compared to a 2-roll mandrel mill, and it is difficult to guarantee dimensional accuracy after rolling. Patent Document 4 discloses an invention which adjusts the zero point of the reduction positions using actual values measured with a wall thickness gauge.

Patent Document 1: JP 2005-111518 A
Patent Document 2: JP H08-71614 A
Patent Document 3: JP H11-123409 A
Patent Document 4: JP 2005-131706 A

DISCLOSURE OF INVENTION

Problem which the Invention is to Solve

In the manufacture of seamless pipes, there is a demand for manufacture of a pipe with a higher working ratio and higher dimensional accuracy than at present from difficult-to-roll materials for which elongation rolling is inherently difficult such as a hollow shell made of stainless steel or of a thin-walled material.

However, as described above, in light of the various advantages and disadvantages of 2-roll to 4-roll mandrel mills, an elongation rolling mill which surpasses a 2-roll mandrel mill has not been developed.

Therefore, as long as a 2-roll mandrel mill is used, it is difficult to obtain a higher working ratio and higher dimensional accuracy than at present.

Means for Solving the Problem

The present invention is a mandrel mill having a plurality of roll stands for performing elongation rolling of a hollow shell to manufacture a mother tube, characterized by having at least one 4-roll stand for wall thickness reduction of a hollow shell and at least one 2-roll stand including the final stand of the mandrel mill on the downstream side of the 4-roll stand.

In the mandrel mill according to the present invention, all of the rolls of the 4-roll stand are preferably driven rolls which are driven by a roll drive motor.

The present invention is also a mandrel mill having a plurality of roll stands for elongation rolling of a hollow shell to manufacture a mother tube, characterized by having at least one 3-roll stand for wall thickness reduction of a hollow shell and at least one 2-roll stand of the hydraulic loading type including the final stand on the downstream side of the 3-roll stand.

From another standpoint the present invention is a process for manufacturing a seamless pipe characterized by performing elongation rolling of a hollow shell using the above-described mandrel mill according to the present invention to manufacture a seamless pipe.

Effects of the Invention

The present invention can provide a mandrel mill which can perform elongation rolling with a much higher working ratio and much higher dimensional accuracy than at present on even a difficult-to-roll material which is inherently difficult to roll such as a stainless steel pipe or a thin-walled steel pipe. In addition, the present invention can provide a mandrel mill which does not easily develop operational problems and which performs elongation rolling with a far greater working ratio and far higher dimensional accuracy than at present even on a difficult-to-roll material which is inherently difficult to roll.

BEST MODE FOR CARRYING OUT THE INVENTION

Embodiment 1

Figure 1:
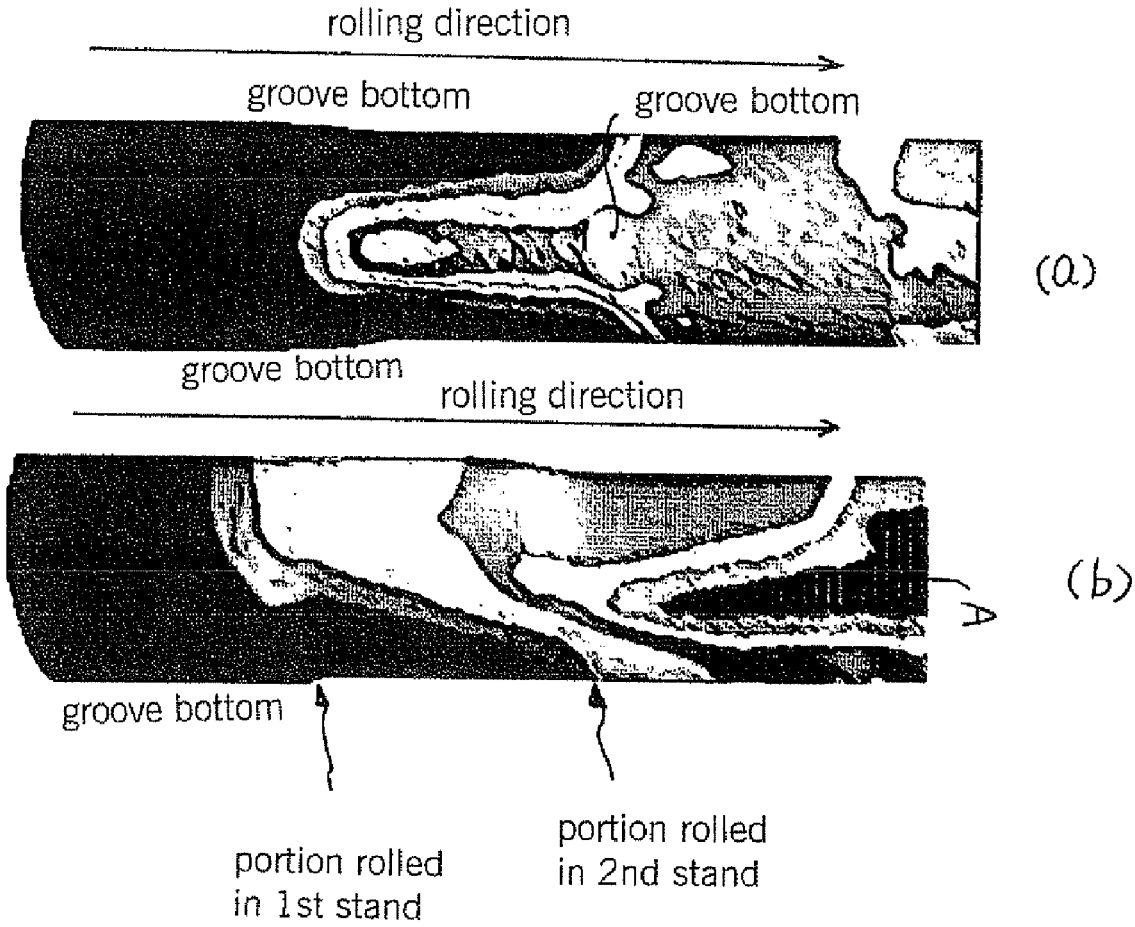
FIG. 1(*a*) is an explanatory view showing the distribution of calculated results of a ductile fracture criterion over a ¼ circumferential area of a hollow shell when using a 4-roll stand in the upstream stands of a mill, and FIG. 1(*b*) is an explanatory view showing the distribution of calculated results of a ductile fracture criterion over a ¼ circumferential area of a hollow shell when using a 2-roll stand in the upstream stands of a mill.

Below, the best mode for carrying out the present invention which is a mandrel mill and a process for manufacturing a seamless pipe will be explained in detail while referring to the attached drawings.

This embodiment of a mandrel mill has a plurality of roll stands for elongation rolling of a hollow shell to manufacture a mother tube. The mandrel mill includes at least one 4-roll stand for wall thickness reduction of a hollow shell and at least one 2-roll stand downstream of the 4-roll stand and including the final stand of the mandrel mill.

Namely, of the plurality of roll stands constituting this mandrel mill, at least one 4-roll stand for wall thickness reduction is positioned in the upstream stands close to the entrance of the mandrel mill, and at least one 2-roll stand including the final stand is positioned in the downstream stands close to the exit of the mandrel mill.

By installing at least one 4-roll stand for wall thickness reduction in the upstream stands, it becomes possible to perform elongation rolling on a hollow shell with an extremely high working ratio before the temperature of the hollow shell decreases. The reduction in the 4-roll stand in the upstream stands allows a length of the circumference of the hollow shell to be maintained with the deformation in the circumferential direction of the hollow shell being approximately uniform.

In general, the temperature of a hollow shell decreases as it is undergoing elongation rolling in a plurality of roll stands constituting a mandrel mill while being moved. As a result, when a hollow shell is made of a material having a high coefficient of thermal contraction (such as an alloy steel containing at least 9 mass % of Cr), the hollow shell sometimes adheres to the mandrel bar due to contraction of its circumference when the mandrel bar is withdrawn after the hollow shell passes through the final roll stand.

Therefore, in order to carry out elongation rolling with a high working ratio and a high dimensional accuracy without the occurrence of operational problems, it is effective to carry out elongation rolling with a high working ratio and nearly uniform deformation in the circumferential direction in the upstream stands where the temperature of a hollow shell is still high such that an adequate length of circumference of the hollow shell can be maintained in the downstream stands where the temperature of the hollow shell decreases.

In this embodiment, all of the rolls in the at least one 4-roll stand for wall thickness reduction provided in the upstream stands are driven rolls which are driven by a roll drive motor.

In order to carry out elongation rolling with a greatly increased working ratio and greatly increased dimensional accuracy without operational problems, as described above, elongation rolling in the upstream roll stands is carried out with a high working ratio and with nearly uniform deformation in the circumferential direction. For this purpose, all of the rolls in the at least one 4-roll stand for wall thickness reduction provided in the upstream stands are preferably driven rolls connected to a roll drive motor so that all of these rolls serve to perform elongation rolling.

By installing at least one 2-roll stand including the final stand in the downstream stands, the circumference of a hollow shell can be maintained, and a large gap can be maintained between the inner surface of the hollow shell and the outer surface of a mandrel bar. As a result, the mandrel bar can be easily withdrawn from the hollow shell after the hollow shell has passed through the final stand. In addition, as stated above, a 2-roll mandrel mill allows zero point adjustment of the reduction position of the rolls to perform easily. Therefore, by installing at least one 2-roll stand including the final stand in the downstream stands, the dimensional accuracy of a mother tube produced by elongation rolling can be maintained at a high level.

The groove bottoms of the 2-roll stand are preferably located at 0° or 90° with respect to the groove bottoms of the 4-roll stand. Making the position of the groove bottoms of the 2-roll stand the same as the position of the groove bottoms of the 4-roll stand (so that there is no phase difference between them) enables a product of higher quality to be manufactured.

As the alloy content of a hollow shell increases or as its wall thickness decreases, it becomes easier for a hole defect to develop during elongation rolling. For example, if a high working ratio is applied only at the center of the groove bottoms of the rolls in the second roll stand of consecutive 2-roll stands in a plurality of roll stands constituting a mandrel mill, a high rolling reduction is applied to just the centers of the groove bottoms even if the reduction outside the centers of the groove bottoms of the rolls is decreased so that the flange portions of the rolls in the second roll stand are not greatly stretched in the lengthwise direction. At this time, elongation in the lengthwise direction at the centers of the groove bottoms increases in the second roll stand, but the material on both sides of the centers of the groove bottoms and the material in the flange portions are restrained, so it becomes difficult for the hollow shell to advance in the rolling direction at the centers of the groove bottoms. As a result, the hollow shell at the centers of the groove bottoms of the second roll stand are corrugated at the entrance of the rolls, and in extreme cases, the hollow shell is rolled in a folded state at the centers of the groove bottoms and a hole defect develops. Thus, hole defects are defects caused by excessive reduction at the centers of the groove bottoms of rolls.

During rolling in the 2-roll stand, if a hollow shell inserted into the stand has a diameter bulging out at the groove bottom portions thereof where the rolling reduction is large is, corrugation tends to occur easily in that portion and hence a hole defect readily develops. In order to supply, as much as possible, a hollow shell which does not bulge out in its diameter at its groove bottom portions, it is desirable that the positions of the groove bottom portions in the 2-roll stand be also in the positions of the groove bottom portions in the immediately preceding stand (on the upstream side).

As a secondary effect of the downstream 2-roll stand, the temperature of the hollow shell can be set to a lower temperature, and the finishing temperature after elongation rolling in a mandrel mill can be lowered to 900° C. or below, for example.

In this manner, in this embodiment, a mandrel mill is constituted so as to have at least one 4-roll stand for wall thickness reduction of a hollow shell and at least one 2-roll stand located downstream of the 4-roll stand and including the final stand of the mandrel mill, whereby elongation rolling with a greatly increased working ratio and dimensional accuracy can be carried out without the occurrence of operational problems.

Embodiment 2

This embodiment of a mandrel mill has at least a 3-roll stand and at least one hydraulically-loaded 2-roll stand located downstream of the 3-roll stand and including the final stand of the mandrel mill.

Instead of providing at least one 4-roll stand for wall thickness reduction in the upstream stands as in the first embodiment, at least one 3-roll stand for wall thickness reduction is provided in the upstream stands, whereby elongation rolling can be carried out with a greatly increased working ratio and dimensional accuracy without the occurrence of operational problems in the same manner as in Embodiment 1.

A 3-roll stand does not have a reference position for each roll. Therefore, it is difficult to expect the accuracy of the reduction position of the same degree as can be achieved in a 4-roll stand. Namely, with a 4-roll stand, if information on the relative position of each roll from its opposing roll is obtained, it is possible to increase the accuracy of the reduction position by adjusting the gap between a mandrel bar and the roll groove bottom portions. However, such a technique of increasing the accuracy of the reduction position cannot be employed with a 3-roll stand because there are no opposing rolls.

Accordingly, in order to carry out wall thickness control during elongation rolling in this embodiment, at least one hydraulically-loaded 2-roll stand is disposed in the downstream stand or stands including the final stand of the mandrel mill such that the reduction position of the rolls can be changed at a high speed during elongation rolling. Since a roll stand loaded by an electric motor cannot vary the reduction position during elongation rolling, it is effective to employ a roll stand of the hydraulically loading type which can change the reduction position during rolling.

In this manner, in this embodiment as well, elongation rolling can be carried out with a greatly increased working ratio and dimensional accuracy without the occurrence of operational problems.

Example 1

The present invention will be explained more concretely while referring to examples.

(1) A mathematical simulation (rigid plastic 3D-FEM) of elongation rolling was performed under below-described conditions (A) and (B) to determine the working ratio and dimensional accuracy of the resulting mother tubes for the following mandrel mills:

(i) a mandrel mill having five roll stands in which a first roll stand and a second roll stand were 4-roll stands for wall thickness reduction and third through fifth roll stands were 2-roll stands (Example 1), (ii) a mandrel mill having five roll stands in which first through fifth roll stands were all 2-roll stands (conventional example), and (iii) a mandrel mill having five roll stands in which first through fifth roll stands were all 4-roll stands (comparative example).

(A) Base data used when carrying out simulation in this example

Dimensions of hollow shell before rolling: diameter of 435 mm, wall thickness of 35.5 mm Dimensions of hollow shell after rolling: diameter of 381 mm, wall thickness of 17.1 mm Material: stainless steel Temperature of hollow shell before elongation rolling: 1000° C.

Diameter of mandrel bar: 347 mm

Total number of roll stands in mandrel mill: 5 roll stands

Diameter of groove bottom of rolls: 500 mm (B) Number and location of 4-roll stands in upstream stands Case (i): The groove bottoms of the rolls of the first roll stand and the groove bottoms of the rolls of the second roll stand are at 45° to each other.

Case (iii): The groove bottoms of the odd-numbered roll stands and the groove bottoms of the even-numbered roll stands are at 45° to each other.

(C) Number and location of 2-roll stands in downstream stands

Case (i): The groove bottoms of the odd-numbered roll stands and the groove bottoms of the even-numbered roll stands are at 90° to each other.

The groove bottoms of the rolls of the third roll stand and the groove bottoms of the rolls of the second roll stand are at 0° or 90° to each other, or Case (ii): The groove bottoms of the rolls of the odd-numbered roll stands and the groove bottoms of the rolls of the even-numbered roll stands are at 90° to each other.

FIG. 1(*a*) is an explanatory view showing the distribution of calculated results of a ductile fracture criterion over a ¼ circumferential area of a hollow shell when using a 4-roll stand in the upstream stands of a mill, and FIG. 1(*b*) is an explanatory view showing the distribution of calculated results of a ductile fracture criterion over a ¼ circumferential area of a hollow shell when using a 2-roll stand in the upstream stands of a mill.

Calculation of the ductile fracture criterion was carried out by the three-dimensional rigid plastic finite element method at the exit of the second roll stand, where it has been empirically found that hole formation easily occurs, when carrying out elongation rolling using a mandrel mill having 4-roll stands in the upstream stands (example of the present invention) or a mandrel mill having 2-roll stands in the upstream stands (conventional example), with the deformation of the hollow shell (stress and strain distribution) being that occurring when the hollow shell is a rigid plastic body and all members except the hollow shell are rigid bodies. In FIGS. 1(*a*) and 1(*b*), based on the calculated stress-strain distribution, the region A for which the calculated value of the ductile fracture criterion (corresponding to the accumulated energy in tension) was at least 0.350) (the portion where there is a high probability of the occurrence of hole formation (rupture)) is shown with hatching.

As shown in FIG. 1(*b*), a region A in which the calculated value of the ductile fracture criterion was at least 0.350 existed when a two-roll stand was used in the upstream stands. In contrast, as shown in FIG. 1(*a*), a region where the calculated value of the ductile fracture criterion was at least 0.350 did not exist when a four-roll stand was used in the upstream stands.

Figure 2:
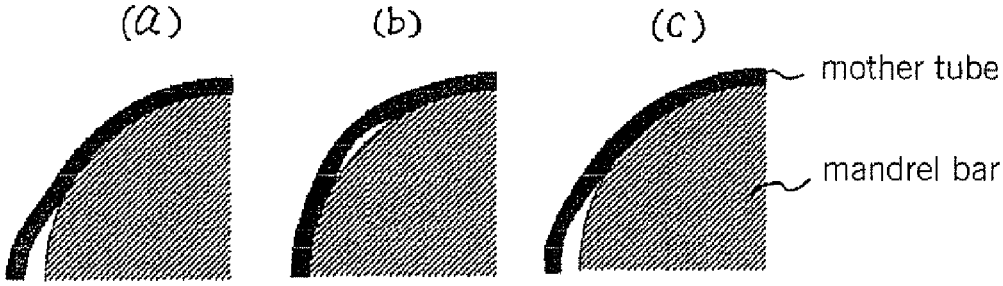
FIG. 2 is an explanatory view showing a comparison of the calculated gap for a ¼ circumferential portion of a mother tube and a mandrel bar at the exit of the final stand for cases (i), (ii), and (iii), in which FIG. 2(*a*) is an explanatory view of the shape of the end of a pipe when using 2-roll stands, FIG. 2(*b*) is an explanatory view showing the shape of the end portion of a pipe when using 4-roll stands, and FIG. 2(*c*) is an explanatory view of the shape of the end portion of a pipe when using 4-roll stands only as the two upstream stands.

FIG. 2 is an explanatory view showing a comparison of the calculated size of the gap between a mother tube and a mandrel bar for a ¼ area of the mother tube at the exit of the final stand for cases (i), (ii), and (iii). FIG. 2(*a*) is an explanatory view showing the shape of the pipe end portion when using 2-roll stands, FIG. 2(*b*) is an explanatory view showing the shape of the pipe end portion when using 4-roll stands, and FIG. 2(*c*) is an explanatory view showing the shape of the pipe end portion when 4-roll stands were employed only in the two stands of the upstream stands.

Figure 3:
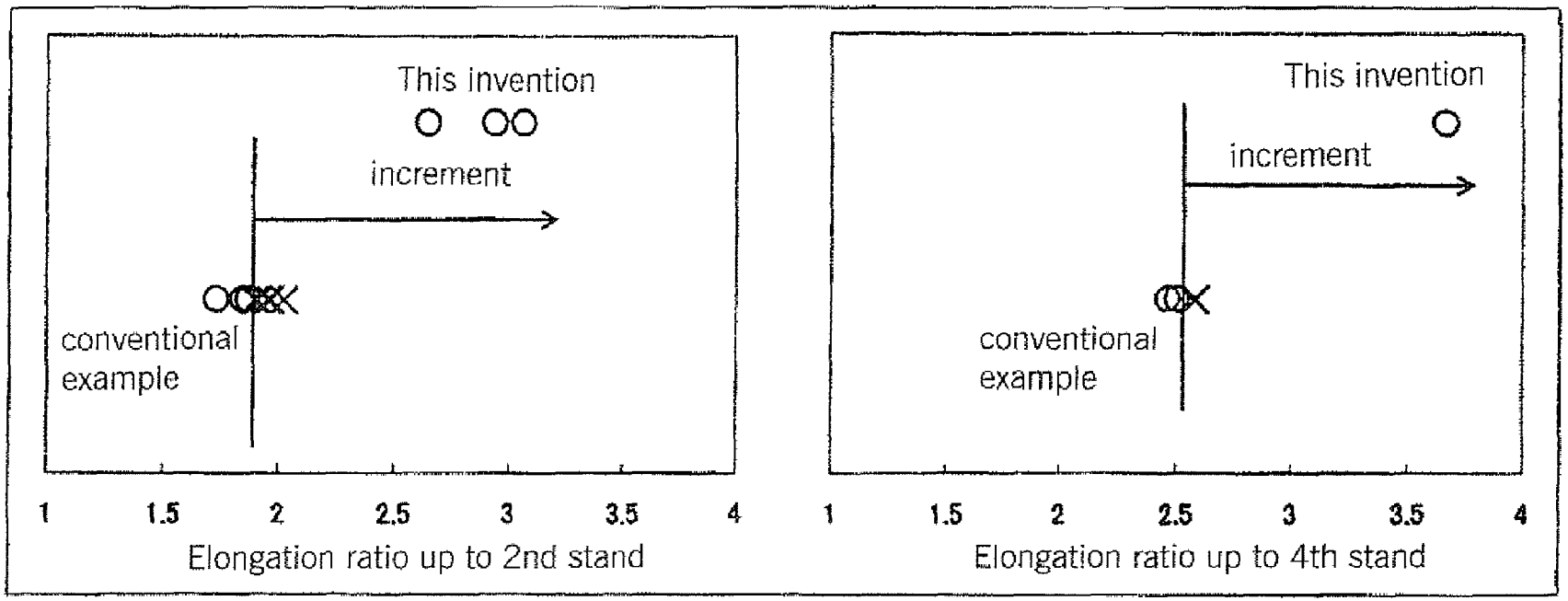
FIG. 3 is a graph showing the results of a rolling test performed on a cold rolled hollow shell having dimensions before rolling of 63 mm in diameter and 4 mm in wall thickness made of antimony-containing lead material using a mandrel bar with a diameter of 50 mm.

FIG. 3 shows the results of a rolling test carried out under the conditions of above-described cases (i) and (ii) for a cold-rolled hollow shell of an antimony-containing lead material having dimensions before rolling of 63 mm in diameter and 4 mm in wall thickness using a mandrel bar with a diameter of 50 mm. In both cases, the rolling reduction was varied. The case in which neither hole formation nor scars were present in the mother tube after elongation rolling is indicated by "O", and the case in which either one was present is indicated by "X". The "elongation ratio" in the figure is a value given by elongation ratio=(length of mother tube after elongation rolling)/(length of hollow shell before elongation rolling)=(cross-sectional area of hollow shell before elongation rolling)/(cross-sectional area of mother tube after rolling).

From FIGS. 1 and 2, it can be seen that by using a four-roll stand in the upstream stands, a sufficient length of circumference can be guaranteed with nearly uniform deformation in the circumferential direction of a hollow shell. As a result, problems such as hole formation do not develop after elongation rolling in the second stand. In addition, by using a two-roll stand in the downstream stands, a sufficient gap can be formed between the inner surface of the resulting mother tube and the mandrel bar in the final roll stand, and the mandrel bar can be withdrawn without problems.

From FIG. 3, it can be seen that with the present invention (case (i)), an elongation ratio of at least 3 can be maintained in the second roll stand, but with the conventional method (case (ii)), the elongation ratio cannot exceed 3 even in the fourth roll stand. Thus, it can be seen that elongation rolling with a markedly increased working ratio is possible according to the present invention.

The invention claimed is:

1. A process for manufacturing a seamless steel pipe by carrying out elongation rolling of a hollow shell using a mandrel mill comprising a plurality of 4-roll stands and a plurality of final 2-roll stands downstream of the 4-roll stands, comprising the steps of:

preparing a hollow shell and inserting a mandrel bar into the hollow shell, performing wall thickness reduction of the hollow shell with the 4-roll stand while contacting the mandrel bar with the inner wall of the hollow shell and while contacting the outer surface of the hollow shell with the rolls of the 4-roll stands, and carrying out final rolling in the 2-roll stands.

2. The process for manufacturing a seamless steel pipe as set forth in claim 1, wherein all of the rolls of the 4-roll stands are driven rolls which are driven by a roll drive motor.

3. The process for manufacturing a seamless steel pipe as set forth in claim 1, wherein said 2-roll stand comprises at least one hydraulically-loaded 2-roll stand.

4. The process for manufacturing a seamless steel pipe as set forth in claim 1, wherein groove bottoms of the 2-roll stand are at 0 or 90 degrees with respect to groove bottoms of the 4-roll stand.

5. The process for manufacturing a seamless steel pipe as set forth in claim 1, wherein an elongation ratio of the mandrel mill is at least 3.

6. The process for manufacturing a seamless steel pipe as set forth in claim 2, wherein said 2-roll stand comprises at least one hydraulically-loaded 2-roll stand.

7. The process for manufacturing a seamless steel pipe as set forth in claim 2, wherein groove bottoms of the 2-roll stand are at 0 or 90 degrees with respect to groove bottoms of the 4-roll stand.

8. The process for manufacturing a seamless steel pipe as set forth in claim 3, wherein groove bottoms of the 2-roll stand are at 0 or 90 degrees with respect to groove bottoms of the 4-roll stand.

9. The process for manufacturing a seamless steel pipe as set forth in claim 2, wherein an elongation ratio of the mandrel mill is at least 3.

10. The process for manufacturing a seamless steel pipe as set forth in claim 3, wherein an elongation ratio of the mandrel mill is at least 3.

11. The process for manufacturing a seamless steel pipe as set forth in claim 4, wherein an elongation ratio of the mandrel mill is at least 3.

* * * * *